US007434527B2

(12) United States Patent
Brighi

(10) Patent No.: US 7,434,527 B2
(45) Date of Patent: Oct. 14, 2008

(54) STEERING AND/OR STABILISING DEVICE FOR MOTORIZED WATERCRAFT

(76) Inventor: Giorgio Brighi, Via Canale 15, Rapallo (IT) I-16035

( * ) Notice: Subject to any disclaimer, the term of this patent is extended or adjusted under 35 U.S.C. 154(b) by 127 days.

(21) Appl. No.: 10/598,186

(22) PCT Filed: Feb. 15, 2005

(86) PCT No.: PCT/EP2005/050653

§ 371 (c)(1),
(2), (4) Date: Aug. 21, 2006

(87) PCT Pub. No.: WO2005/080190

PCT Pub. Date: Sep. 1, 2005

(65) Prior Publication Data

US 2007/0137543 A1 Jun. 21, 2007

(30) Foreign Application Priority Data

Feb. 24, 2004 (IT) ..... GE2004A0013

(51) Int. Cl.
*B63B 39/06* (2006.01)

(52) U.S. Cl. ..... 114/126

(58) Field of Classification Search ..... 114/126
See application file for complete search history.

(56) References Cited

U.S. PATENT DOCUMENTS 3,757,723 A * 9/1973 Pangalila ..... 114/126
4,280,433 A * 7/1981 Haddock ..... 114/140

FOREIGN PATENT DOCUMENTS

FR 1301936 A 8/1962
GB 803602 A 10/1958
GB 888452 A 1/1962

* cited by examiner

*Primary Examiner*—Stephen Avila
(74) *Attorney, Agent, or Firm*—David A Guerra

(57) ABSTRACT

Steering and/or stabilising device for motorised watercraft, with at least two operating units comprising each a retractable fin (4), characterised in that the retractable fins of each operating unit are contained in tubular watertight casings (5) open on the bottom or on the underwater area of the hull sides and located completely or for their prevailing portion inside the hull, one on the starboard side and the other on the port side, each fin (4) being guided axially in the associated tubular casing (5) and being movable by an actuator (10) outwards and inwards in the casing (5), so that it can be retracted in the casing (5) or projected out of the hull for a variable extent in the water.

19 Claims, 9 Drawing Sheets

STEERING AND/OR STABILISING DEVICE FOR MOTORIZED WATERCRAFT

CROSS-REFERENCE TO RELATED APPLICATIONS

This application is an U.S. national phase application under 35 U.S.C. §371 based upon co-pending International Application No. PCT/EP2005/050653 filed on Feb. 15, 2005. Additionally, this U.S. national phase application claims the benefit of priority of co-pending International Application No. PCT/EP2005/050653 filed on Feb. 15, 2005 and Italian Application No. GE2004A000013 filed on Feb. 24, 2004. The entire disclosures of the prior applications are incorporated herein by reference. The international application was published on Sep. 1, 2005 under Publication No. WO 2005/080190.

BACKGROUND OF THE INVENTION

1. Field of the Invention

The invention relates to steering and/or stabilising device for motorised watercraft with at least two operating units comprising each a retractable steering and/or stabilising fin.

A motorised watercraft requires a steering device which is not only prompt, precise and light but also offers a minimal resistance to forward movement in the water.

The invention is based on the fact that any watercraft having a completely symmetrical keel and with balanced propulsive forces tends to keep a constant course when sailing if no extraneous forces such as wind, wave motion, current etc. intervene to change the direction of navigation. This is particularly true for fast motorised watercrafts with modern hulls having deep, V-shaped keel Studies and trials have been carried out on steering devices having two operating units, each comprising a retractable fin and fitted outside the stern of the watercraft in symmetrical positions, one to the starboard side and the other to the port side, these steering fins being kept out of the water during navigation on course and being inserted alternatively and for different extents into the water on the starboard side or on the port side, only when a change of course is required.

2. Description of the Prior Art

A steering device of this type is known from the document EP 0518229 A1. Each unit of this known device comprises a steering fin attached on the outside of the transom and swinging up and down. A operating unit of this kind is showed in FIG. 1 of the accompanying drawings, in which the swinging steering fin mounted outside of the transom T is indicated with 2 and is actuated by a cylinder 1 located as well outside of the transom T.

This known kind of steering device yielded highly favourable results in trials, in which it was confirmed that a watercraft navigating without rudders showed no greater instability in maintaining a course than a watercraft provided with conventional rudders, and indeed revealed that steering fins immersed alternatively and for variable extents on the starboard side and on the port side, provided course maintaining and manoeuvring characteristics which were clearly not inferior to those of the conventional rudder systems, with the considerable advantage of causing no resistance to forward movement when the steering fins are retracted during on a constant course.

The known steering device of this kind was not generally applied because of the marked tendency to conservatism characteristic of marine design in general and because of the problems arising from the particular type of steering fins attached on the outside of the transom and projecting from the transom in an area which is normally used for bathing, particularly in leisure vessels. It was also feared that any collision with a quay when backing might damage the integrity of the steering means.

A known stabilising device of the kind mentioned above for motorised watercraft comprises two operating units located preferably in the middle zone of the watercraft, one to the starboard side and the other to the port side and the respective stabilising fins project in the water, placed transversely to the side.

The stabilising fins now known generate forces capable to oppose rolling effect opportunely rotating on a shaft similarly to the conventional rudders. The complicate system of the rotation does not permit except for large watercraft or for ship the possibility to be retractable when the stabilising effect of the fins is not required. This property of the known fins does not permit its application on small or medium size watercraft particularly if fast or planning because the of the excessive resistance in the forward advancement in the water.

SUMMARY OF THE INVENTION

It is an object of the present invention to provide a steering and/or stabilising device for motorised watercraft, with at least two operating units comprising each a retractable steering and/or stabilising fin of the aforementioned general type and according to the pre-characterizing part of claim 1, which device has a simple construction, occupies a minimum space, has a limited weight and a low cost and a simple and easily manoeuvrable actuating system and above all is practical and reliable.

The invention aims also to provide a steering device of this kind, whose steering fins project predominantly and preferably under the keel, rather than on the outside behind the transom, for reasons of practicality, appearance and safety and above all for functional reasons, in order to operate in a region where the water pressure is greater and in such a way as to prevent the occurrence of cavitations or airing phenomena such as those which may occur with a known steering blade or rudder inserted into open water, and keeping completely free the outside of the transom.

These problems are solved according to the invention by a steering and/or stabilising device for motorised watercraft with at least two operating units located one on the starboard side and the other one on the port side in a transversal plane of the watercraft and comprising each a rectractable fin, this device being characterised in that the fin of each operating unit is contained in a watertight tubular casing open on the bottom or on the underwater portion of the hull sides and located completely or for its prevailing portion inboard, i.e. inside the hull, each fin being guided to slide axially in the associated tubular casing und being movable by manually or by power assisted actuator outwards and inwards in the casing, so that it can be retracted in the casing or projected out of the hull for a variable extent.

When using the device according to the invention as a steering device, the tubular casings of the operating unites are located in the stern zone of the hull and have a pit-like form, being substantially vertical or inclined on the bottom and in a transversal plane the watercraft. The actuators of the operating units are interconnected und manoeuvrable so that the respective fins can be retracted during sailing on course or projected individually and alternatively or for different extent in the water on one side or the other, thus acting as steering fins.

When using the device according to the invention as a stabilising device, the tubular casings of the operating units, oriented preferably horizontally, are also located symmetrically and both lying in a transversal plane preferably in the middle section of the watercraft or whatever lying between the middle and the stern.

The actuators of the operating units are interconnected und manoeuvrable so that the respective fins can be retracted during sailing in calm water or projected in the water totally or partially on one side or on the other one during sailing in rough seas, thus acting as stabilising fins to oppose the effect of the roll.

BRIEF DESCRIPTION OF THE DRAWINGS

The objects and advantages of the present invention will appear more clearly from the following specification in conjunction with the accompanying schematic drawings, in which:

In FIGS. 2 to 11 of the drawings a preferred embodiment of an unit of a steering device for motorised watercraft according to the invention is illustrated.

Figure 9:
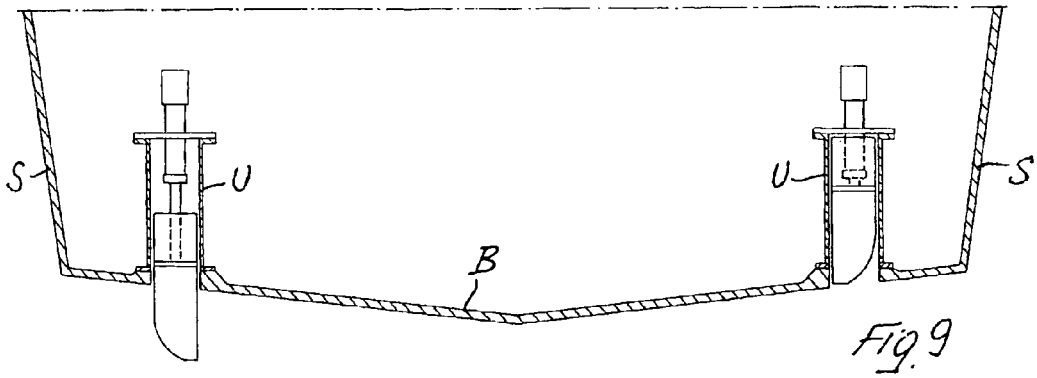
FIGS. 9 and 10 are schematic transversal sections through the hull of a watercraft showing various orientation of the operating units of a steering device according to FIGS. 2 to 5.
Figure 10:
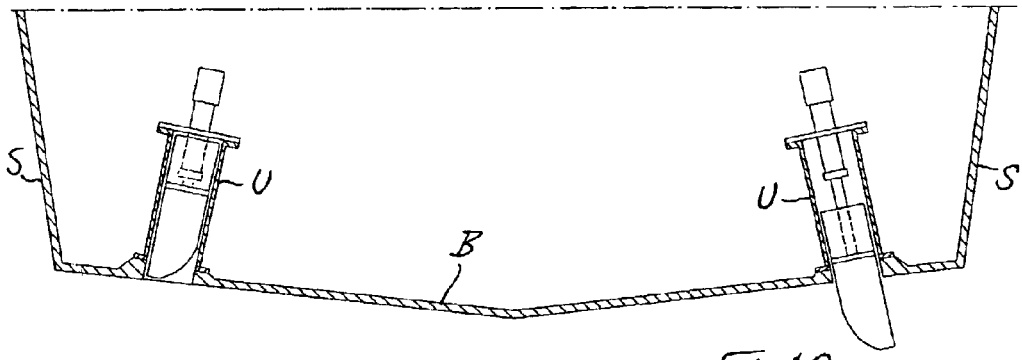
Figure 11:
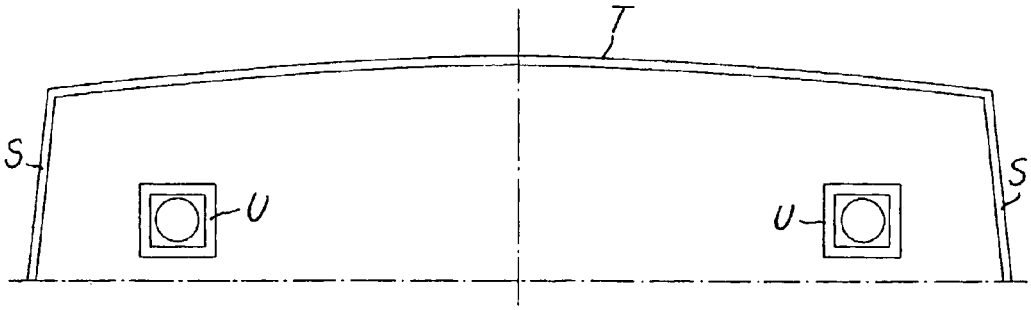
FIG. 11 is a schematic plan view of the couple of units of a steering device shown in the FIG. 9 as transversal section

With reference to the drawings, and with particular reference to FIGS. 9 and 10, the steering device according to the invention has a pair of units U located in the stern zone of the watercraft one on the starboard side and the other on the port side.

The parts of the hull of a motorised watercraft are indicated by: T is the transom, B is the keel, S is the side and U is a steering unit of the steering device according to the invention.

Figure 1:
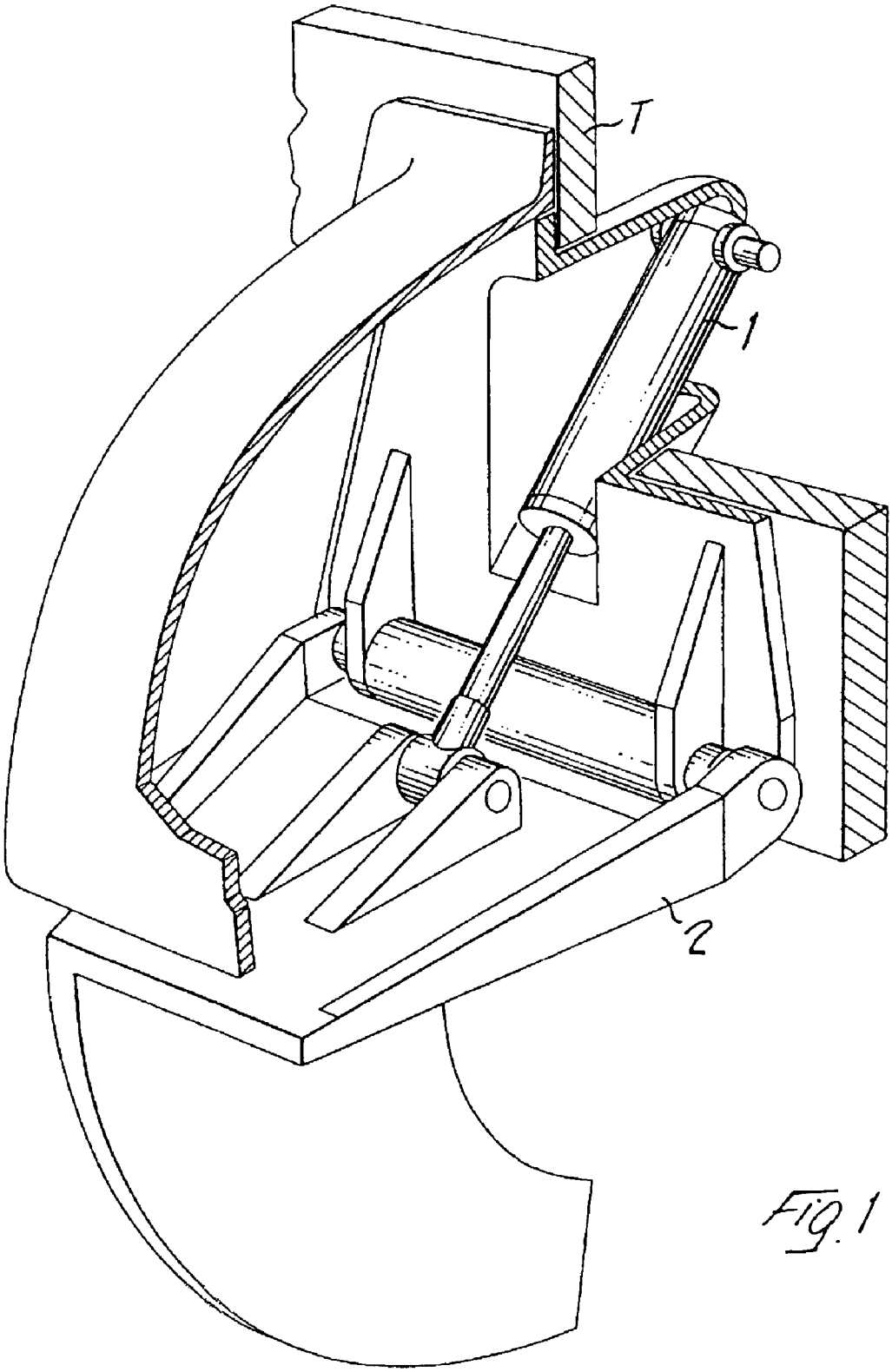
FIG. 1 is a perspective view of an steering device unit according to the state of the art.
Figure 2:
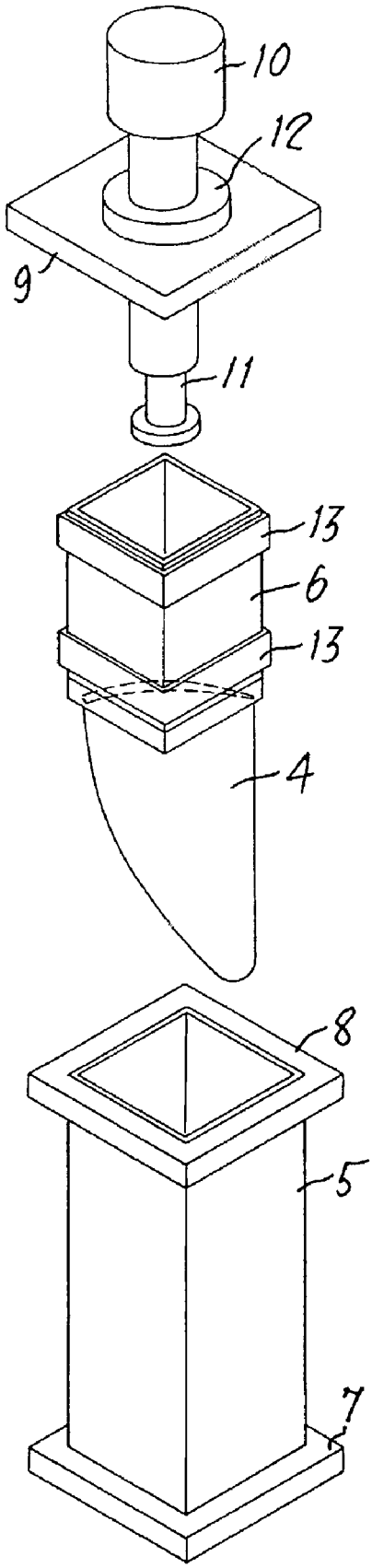
FIG. 2 is an exploded perspective view of the main components of a steering device unit according to the invention.
Figure 3:
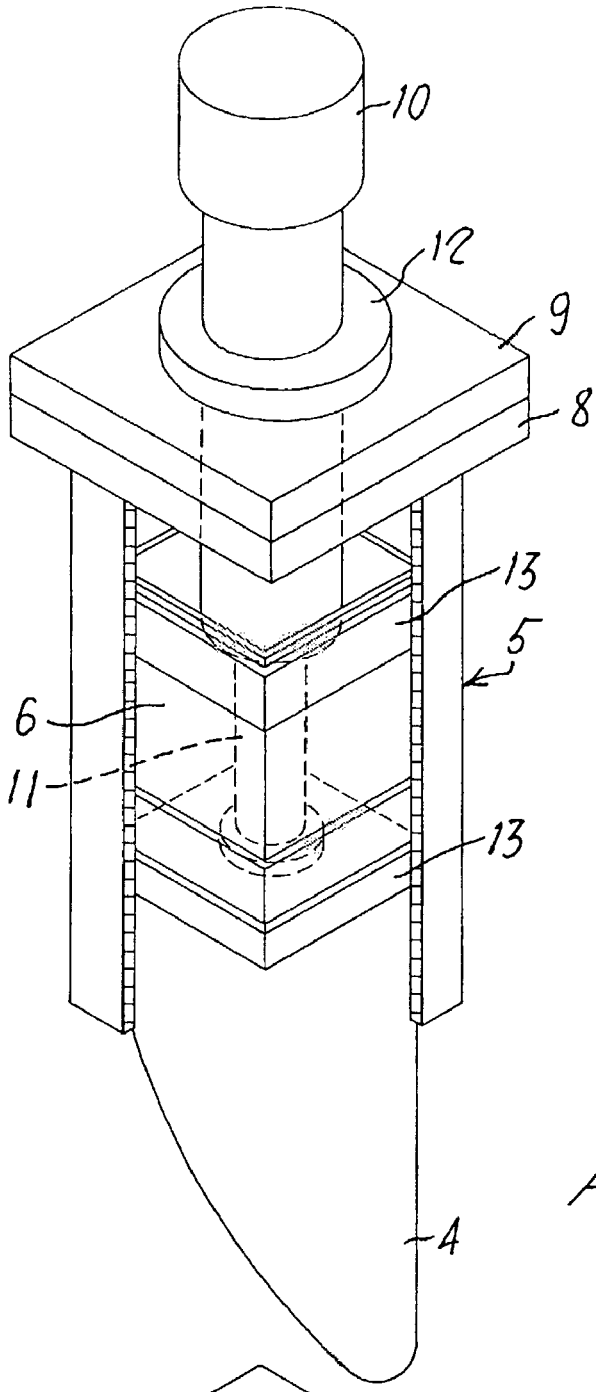
FIG. 3 is a perspective view of the assembled steering device unit according to FIG. 2.
Figure 5:
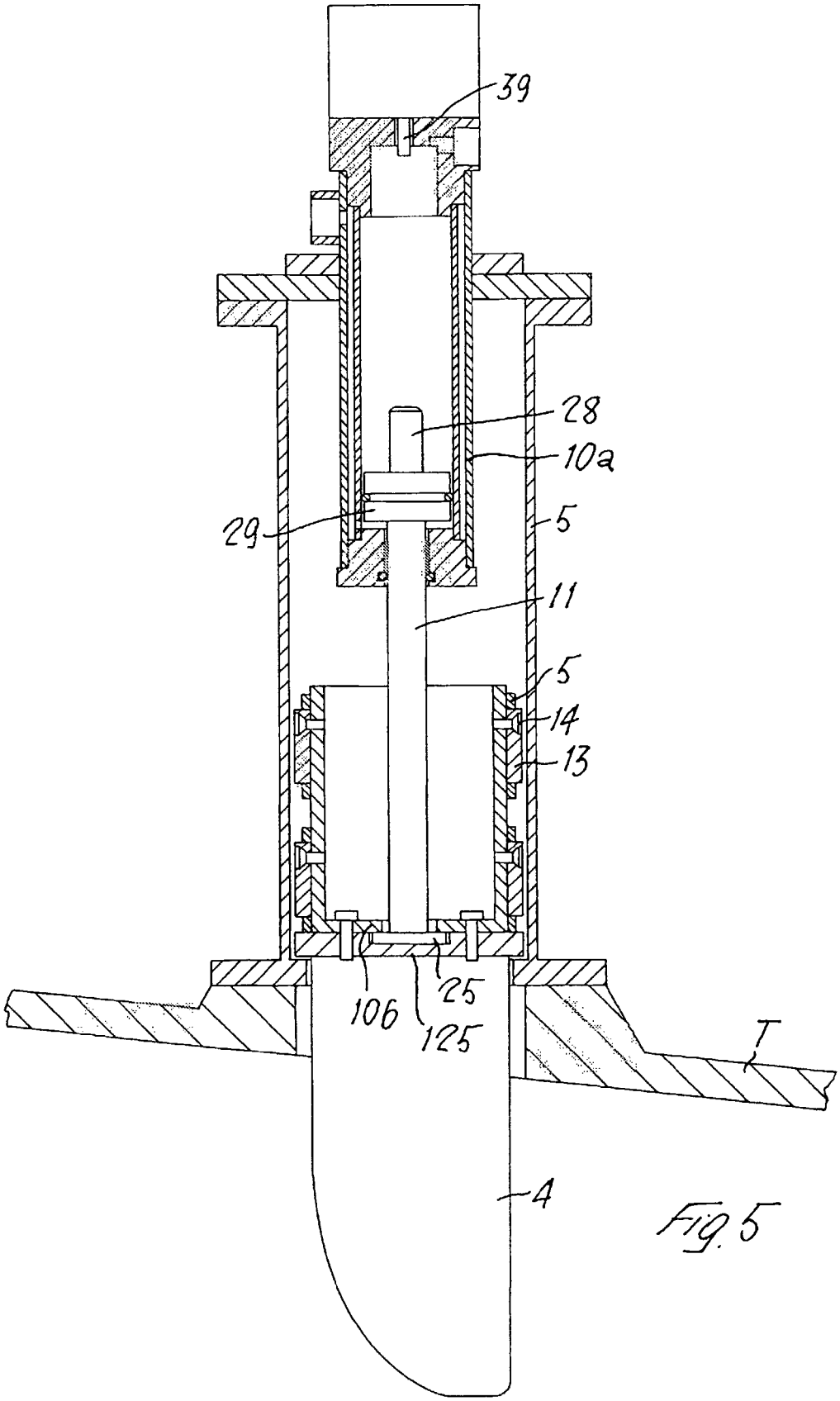
FIG. 5 is a vertical section of the steering device unit according to FIGS. 2, 3 and 4.

FIG. 2 is an exploded perspective view of the three main parts making up each unit U of a steering device for watercraft according to the invention, shown in the pre-assembly position, while the complete steering unit is also shown in an axonometric view in FIG. 5, which relates to the starboard side embodiment, the other one unit being a mirror image of the latter.

Each unit of the steering device is provided with a movable fin, referred to in a general way as a blade, indicated by the number 4 in the drawings. This blade is sliding vertically in the tubular watertight pit-like casing 5 which is fitted essentially inboard, and has a cross section which is preferably square, rectangular or at least prismatic, in order to withstand the stresses due to the action of the water.

The blade 4 is also connected directly to a box-like guide structure 6 open at its top and is closed at its base where the blade 4 is connected. The cross section of the guide box 6 is similar to that of the casing 5 but on a scale reduced sufficiently to permit the interposition of suitable anti-friction means 13.

The blade 4 can be connected to the guide box 6 by means of bolts or another system, but can also be formed in one piece with the guide box 6, by casting for example. The guide box 6 can also have apertures or holes for lightening if required.

The blade 4 has a special shape in connection to the speed and characteristics of the watercraft and is designed according to hydrodynamic profiles similar to hydrofoil wings, which are markedly different from those of a conventional rudder for which the essential condition is that it should have a symmetrical profile, since it operates alternatively on both surfaces. For example, in the case of watercrafts which are not particularly fast, a "roofing tile" concave profile can be used, the blade profile being similar to a circular sector, and then being gradually reduced in width towards the end and twisted to initiate the manoeuvre with an angle of attack of a few degrees and subsequently reaching an inclination of 45°-50°. On the other hand, in the case of high-speed watercraft, an anti-cavitation profile can be used with an eventual helical configuration.

In any case, it should be noted that such experimentation is particularly facilitated by the fact that the blade being tested can be changed directly inboard.

Finally, the blade 4 can be made from any sufficiently strong material, such as bronze, stainless steel, titanium alloy or the like, provided that it is compatible with the hull material and suitable in respect of galvanic corrosion.

Each casing 5 is provided with a suitable flange 7 at its base so that it can be securely fixed to the bottom of the hull, and with a flange 8 at the top to receive a watertight cover 9.

Figure 4:
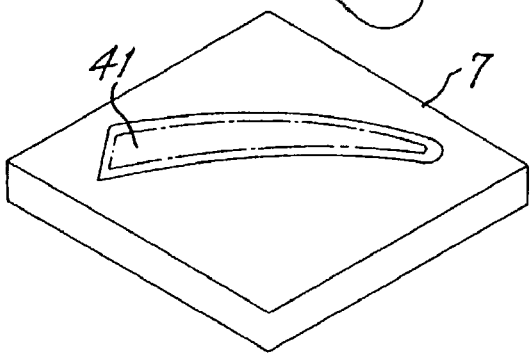
FIG. 4 is a perspective view of the base flange of the steering device unit according to FIGS. 2 and 3.

The flange 7 is constructed as indicated in FIG. 4 and is practically closed except for the presence of a slot 41 through which the blade 4 can pass during its downward and upward movement. This slot 41 matches to a slot formed in the bottom of the hull. The slot leaves a clearance around the blade 4 which is barely sufficient to allow the water to flow out of and into the casing during the manoeuvres. The profile of the slot 41 corresponds to the profile of the blade 4.

The casing 5 can economically be formed from a drawn square or rectangular stainless steel section, in a similar way to the guide box 6. If the casing is required to be particularly light, it can be formed by casting from titanium alloy, or can be formed by a robust metal guide frame inserted in a protective structure made from glass-fibre reinforced plastic.

Each unit U of the steering device is provided with an actuator 10 consisting mainly of a double-acting hydraulic cylinder, whose rod 11 is connected to the base of the guide box 6 to provide the vertical movement of the blade 4 together with its guide 6. The actuator 10 is fitted directly or by means of a flange 12 to the cover 9 of the casing 5. The cover 9 is fixed on an upper flange 8 of the casing 5.

An anti-friction means 13, made in a similar way to that which is normally interposed between the sliding telescopic jibs of a crane, is interposed between the guide box 6 and the casing 5.

In particular, there are provided cleats or strips of anti-friction material 13, mainly fitted on the outer walls of the guide box 6, capable of withstanding the reaction forces and having a low coefficient of friction. They must not have hygroscopic properties, in other words must not swell when exposed to water for long periods.

Many kinds of these strips are available on the market at present.

The anti-friction strips 13 are kept in position as shown in FIG. 5 by means of countersunk-head captive screws 14 and thinner metal strips 15, fitted above and below the said strips 13 to the guide box 6 by the method used for crane jibs.

Figure 7:
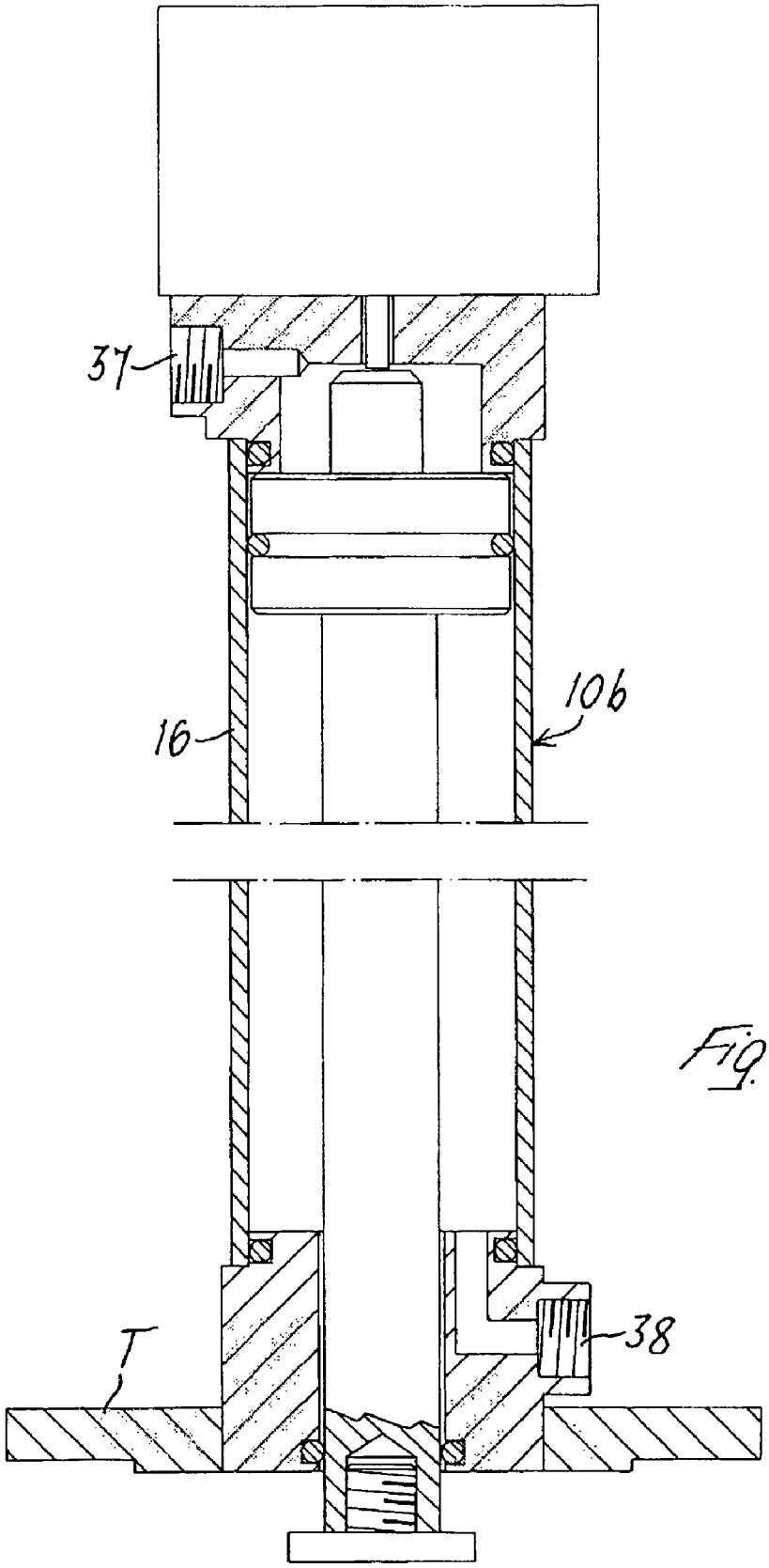
FIGS. 7 and 8 are vertical longitudinal sections of two of the actuating cylinders of the steering device unit.
Figure 8:
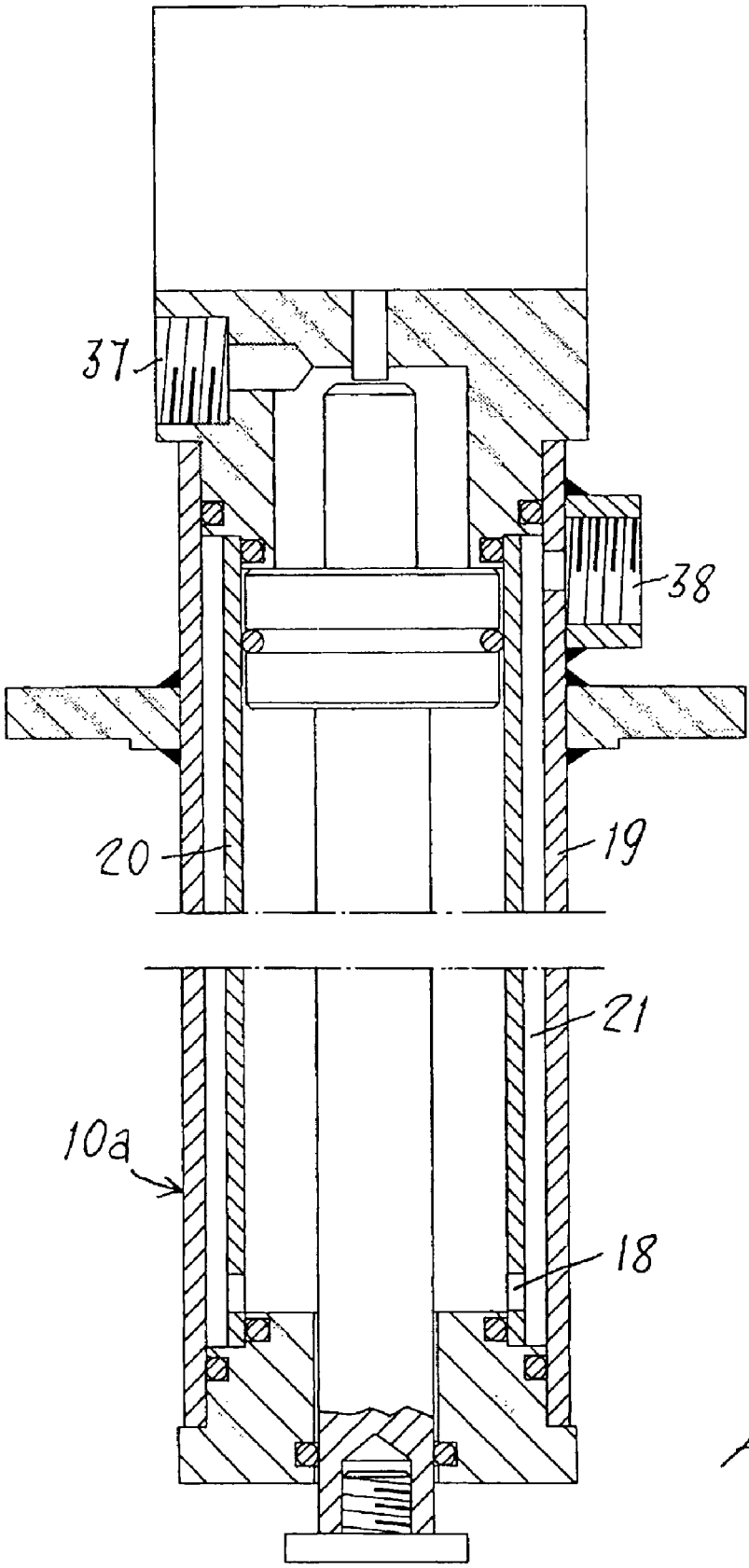

FIGS. 7 and 8 show two versions 10*a* and 10*b* of the actuating cylinder. They differ from each other in that the version of FIG. 7 is an ordinary double-acting cylinder with a single wall 16 and with inlet ports 37 and 38 located at the two ends of the said wall 16. In this case, the cylinder 10*b* projects practically entirely above the cover 9 of the casing 5. The version 10*a*, according to the invention is shown in FIG. 8. According to this embodiment, the cylinder 10*a* is provided with an outer wall 19 and with an inner wall 20 positioned in such a way that the supply to the lower chamber of the cylinder passes into the gap 21 formed between the outer and the inner walls 19, 20 and enters the lower chamber of the cylinder through holes 18 formed in the base of the lower chamber, with the advantage that the two inlet connections 37 and 38 are both located on the top of the cylinder 10*a*. With this version, therefore, most of the cylinder 10*a* can be housed in the guide box 6, thus providing the advantage of a smaller height of the steering unit.

An important and original characteristic of the steering device according to the invention is the type of connection provided between the rod 11 of the actuating cylinder 10 and the guide box 6, which is fixed to the blade 4. The slidability of the guide box 6 within the casing 5 has to be ensured in all cases for the correct operation of the steering device, and for this purpose a clearance of a certain amount, must be provided, according to the size of the system, machining not generally being specified for the casing 5 or the box 6. For this purpose, the rod 11 of the actuating cylinder 10 must be capable of transmitting the movement to the guide box 6 without transversal stress on the said rod. Therefore, the rod 11 of the cylinder is provided at its lower end with a strong disc 25, as shown in FIG. 5, which is contained between the top 125 of the blade 4 and the base 106 of the box 6, and is radially movable. The rod 11 of the cylinder passes with a sufficient radial clearance through a hole in the base 106 of the box 6 for allowing the radial motion of the said disc 25. The blade 4 and the box 6 can freely move transversally to the side 25 and to the rod 11 of the cylinder 10 for being pushed downwards and retracted axially without transmitting horizontal forces to the cylinder rod 11.

Figure 6:
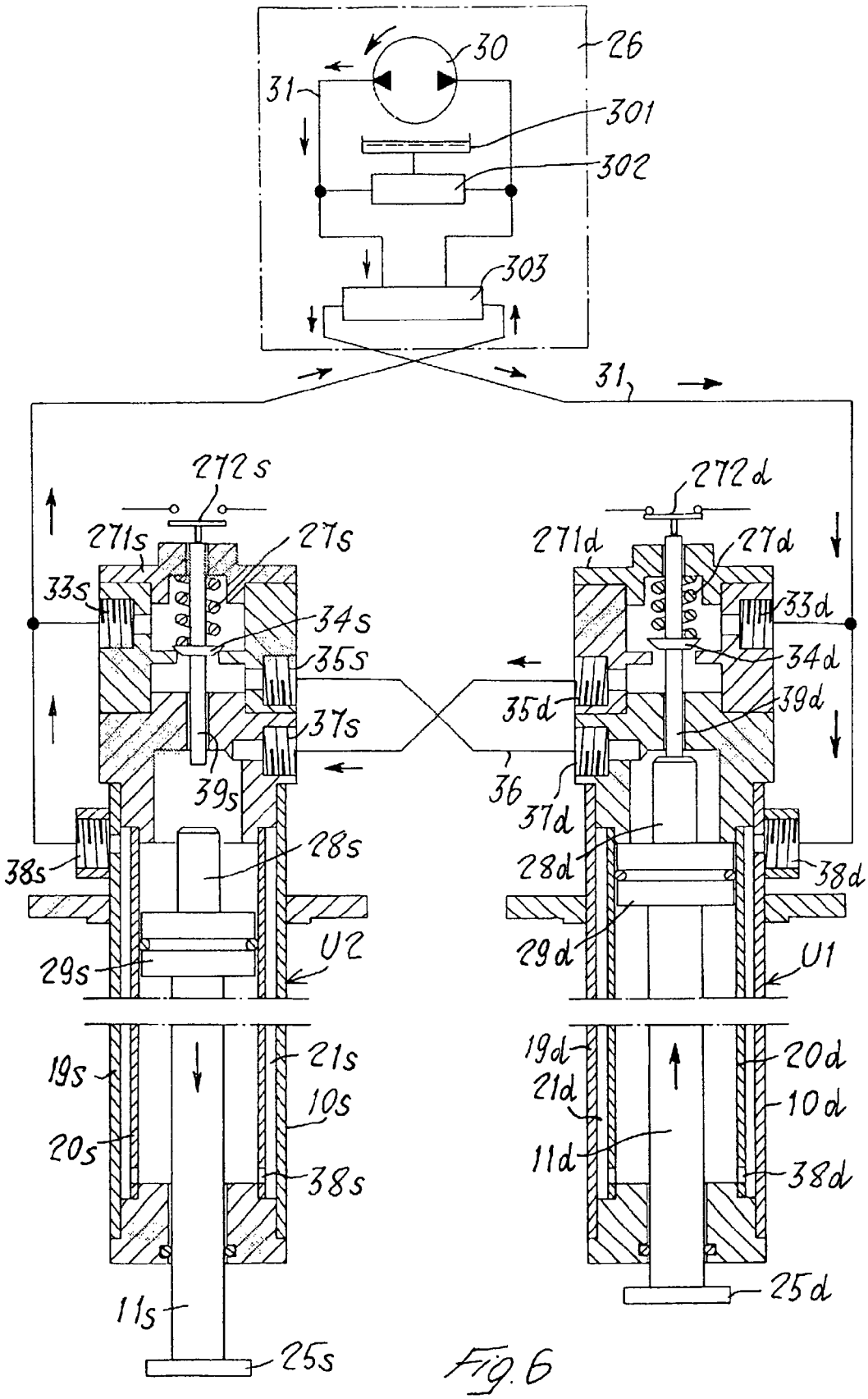
FIG. 6 is the control circuit diagram of the actuating cylinders according to FIGS. 7 and 8.

Another characteristic of the steering device according to the invention is the type of hydraulic system used for the remote control shown in FIG. 6, which relates to an installation provided with a reversible manual pump 30 with conventional, accessories, shown in the frame 26, and comprising a reservoir 301, a reservoir intake and return valve 302, and a double controlled non-return valve 303 acting as a blocking device. The system 26 can be replaced by any other type of conventional servo-assisted hydraulic system for rudder operation.

In both cases, however, the remote control installation must be provided with sequence valves to prevent the actuation of one blade 4 if the other one has not been retracted.

Suitable sequence valves for this purpose are available on the market, and are generally controlled by the rise in pressure in the chamber of the hydraulic cylinder 10*a* as the end of the stroke is reached, but for greater safety the invention preferably provides the use of two special sequence valves 27*d* and 27*s*, fitted on the top of the actuating cylinders 10*a* of the steering units U1 and U2 on the starboard and the port side respectively as shown in FIG. 6. Each of these valves is operated directly by a top extension 28 of the piston 29 of the cylinder 10*a* of the respective unit U1, U2, when the upper limit of the stroke of the piston 29 has been reached, in other words when the blade 4 has been fully retracted. In this position, the extension 28 of the piston 29 raises the control rod 39 of the sequence valve, thus allowing the passage of oil to supply the cylinder of the opposite steering unit. The operation of these valves is made clearer by the diagram in FIG. 6.

If the shaft of the manual pump 30 is moved in the anti-clockwise direction for example, the oil is sent into the pipe 31 as indicated by the arrows, and, after passing through the conventional lock valve 303, the said oil reaches the inlet 38*d* of the cylinder 10*a* of one steering unit U1 on the starboard side. The oil flows from the port 38*d* through the gap between the two walls of the cylinder, and pushes the piston 29*d* to the top of the cylinder, thus ensuring that the corresponding blade 4 is completely retracted, while the extension 28*d* of the piston 29*d* simultaneously raises the control rod 39*d* of the valve, thus allowing communication between the ports 33*d* and 35*d* and consequently the flow of oil in the pipe 36 connected to the inlet 35*s* of the cylinder 10*a* of the other steering unit U2. Consequently the piston 29*s* of the cylinder 10*a* of this other steering unit U1 and the corresponding blade 4 are pushed down and the watercraft turns to port as required.

To reverse this manoeuvre, it is simply necessary to turn the shaft of the manual pump 30 in the opposite direction, and all the operations will be repeated in the opposite direction. More particularly, the blade 4 of the steering unit U2 on the port side will initially be retracted and, when permitted by the opening of the respective sequence valve 34*s*, the blade 4 of the steering unit U1 in the starboard side can be made to move downwards, causing the watercraft to turn in the starboard direction.

The sequence valves 27 are characterised in that the push rods 39 of the shutters extend beyond the covers 271 so that they can be used to close electric limit switches 272 to signal to the helmsman the condition of simultaneous opening of the sequence valves, a condition in which both blades are fully retracted, corresponding to the central position of the rudder in conventional systems, this signal being of the audible and/or visual type or in the form of a small vibration of the wheel which is perceptible only to the helmsman.

The proposed steering device provides the following particular advantages in addition to the general advantages which have been listed, namely:

- A considerable saving of weight and cost owing to the absence of rudder head, tiller, stuffing box and conventional machinery. Furthermore, a smaller and lighter blade, designed to receive the thrust of water from one side only, can be used with equal effect
- A reduced manoeuvring power requested being all thrust of the water supported by the hull and not by the operator effort or by the mechanical power of the steering gear
- The possibility of convenient standardization of the casings and guides.
- The absence of any kind of stuffing box, since the system is contained in a closed and watertight unit.
- The possibility of extracting the whole blade and corresponding actuator assembly directly into the vessel, since the assembly is contained in the watertight casing with a cover above floating line. This characteristic is also useful because the blade can be replaced with another more efficient one at any time, or can be released from any bodies such as nets, ropes, etc., in which it may become entangled.

The blade has to be extended only by a very small amount below the keel to keep the watercraft on course, so that the forces on the rudder are very limited and manual control becomes possible even for larger watercraft.

Another important characteristic is due to the type of actuators used, which are of the double-acting type with a non-passing through rod and therefore with an upper chamber, which is the active chamber, having a larger volume than the lower chamber. In practice if an operating time of 10 seconds, for example, will be required for the total immersion of the blade, the retraction could take place in 5 seconds, since the recovery takes place in half the time because the chamber of the cylinder has to be filled from the rod end. In practice, the rudder responds more rapidly to the helmsman's command.

Finally, the two operating units are not interconnected mechanically but only hydraulically as described with reference to FIG. 6, and therefore the space between them is completely free, this space being particularly useful in the stern area where a watertight recess can be provided at sea level for housing, for example, a tender or a ladder or even an attractive raft which can be pushed out from the stern for the purposes of bathing. This characteristic is of major importance in the case of catamarans.

DESCRIPTION OF THE RETRACTABLE APPENDAGES USED AS STABILIZERS

The stabilising fins used at the present time essentially consist of rudder blades with their axes preferably horizontal or sub-horizontal, normally placed in the proximity of the middle the watercraft, and provided with the system of control faster and always automatic It should be borne in mind that, at the present time, non-retractable conventional fins are generally fitted on large displacement watercraft and only in special case on larger ship retractable fins are installed because at present state of the art the system is very complex and highly expensive.

Figure 13:
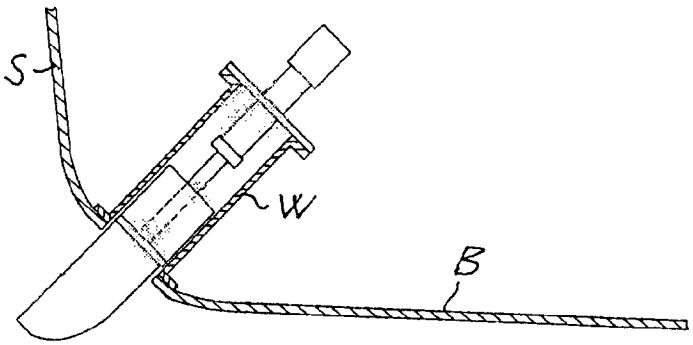
FIG. 13 is a fragmentary transversal section through the hull of a watercraft showing a preferable orientation of a stabilising device unit.
Figure 12:
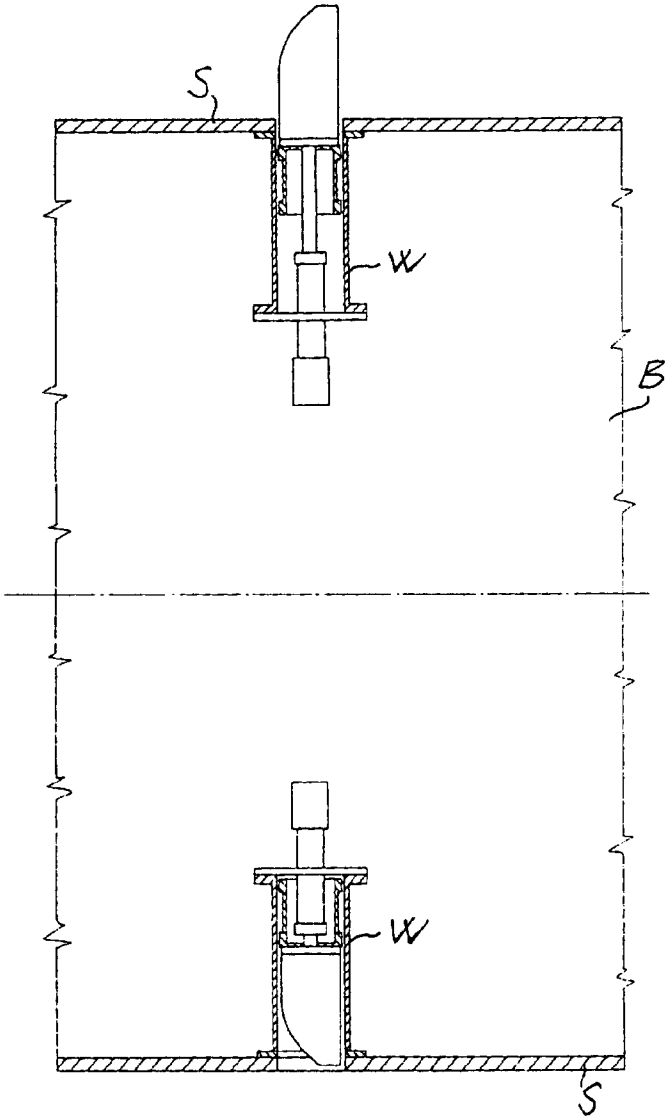
FIG. 12 is a schematic plan view in middle section, or alternatively in a section placed between middle and stern of watercraft, of a motorised watercraft provided with two side units of a stabilising device according to the invention.

The remarks made concerning conventional rudders, to the effect that they require manoeuvring systems on which some or all of the dynamic forces of the water are discharged, are also applicable to present-day stabilising fins, and therefore it will be easily understood that the retractable appendage units according to the invention can also conveniently be used as stabilising fins, in which case they are positioned with horizontal or sub-horizontal axes, as shown for instance in FIGS. 12 and 13, whose characteristic of being in all cases retractable and therefore also suitable for fitting to fast motor craft, since they will be used only in rough seas and therefore at lower speeds.

FIGS. 12 and 13 show how the units fully described previously, and indicated by W in this case, can also be fitted on board for this application. In this case also, the parts of the hull are indicated by the same symbols, namely T for the transom, B for the bottom of the hull and S for the sides of the watercraft.

The transversal section of the hull represented in FIG. 12 could be normally comprised between stern and middle ship.

Clearly, it is not possible to use each unit to reverse the direction of the thrust, and therefore it will be necessary to have at least two units, one on the starboard side and one on the port side, to maintain the stabilization, but on the other hand the advantages will be considerable and practically the same as those listed for the steering means, namely:

The possibility of sailing with the fins retracted when not in use, even in the case of small units.

The greater efficiency of the blades, which are designed to receive the thrust on one side only.

The lower production cost of the blade and servomotor assembly.

The lower power of the servomotor and therefore greater standardization of the various models.

The possibility of using existing control systems almost in their entirety.

The units proposed for this application are not illustrated in detail, since they are completely identical to those illustrated for the steering means, the only difference being the zone where they are placed on board, and moreover small differences could be introduced for the shape of the blade, as well the ratio between the width and the length of the blade.

The invention claimed is:

1. A retractable fin device for steering or stabilizing a motorized watercraft having at least one hull, said retractable fin device comprising:

at least two operating units each having at least one retractable fin, said retractable fins of each operating unit being contained in tubular watertight casings open on the bottom and located for their prevailing portion inside the hull, one on the starboard side and the other on the port side;

an actuator associated with each of said operating units for moving said fins outwards and inwards out of the hull during the navigation for a variable extent in the water; and a guide part coupled to the root of said retractable fin sliding outward and inward into said watertight tubular casing;

wherein said tubular casing and said sliding guide having both prevailing rectangular or prismatic section in order to avoid any tilting rotation of said fin along its axis when moved:

wherein each of said fins being connectable to said guide closed at the base and open at the top, characterized in that said guide can slide within said tubular casing and has a section similar to that of said tubular casing, said guides being reduced in scale to said tubular casing permitting the eventual interposition of suitable anti-friction elements fitted to said guide;

wherein said tubular casing of said operating units is made from a generally rectangular section made from material suitable for the type of hull, said casing being provided with at least one flange on its top to receive a watertight cover and an additional flange for its secure fixing to the hull, said additional flange being provided with a slot to allow the movement of said fin with a clearance which is sufficient to allow the water to flow out and in.

2. The retractable fin device according to claim 1, wherein said fin of each of the said operating units have a wing-like profile with a constant angle of incidence.

3. The retractable fin device according to claim 1, wherein said fin of each of the said operating units have a variable angle of attack between the tip and the root to provide progressive action during its immersion.

4. The retractable fin device according to claim 1, wherein said tubular casing of each operating unit has a pit-like form, and a generally rectangular configuration.

5. The retractable fin device according to claim 4, wherein said actuators of said operating units are interconnected and maneuverable so that said respective fins can be moved individually and alternatively in the water flow for a different extent in one side or on the other one, causing in this way reaction forces of variable entity on the hull capable to steering or reducing the rolling effect.

6. The retractable fin device according to claim 1, wherein said tubular casings of said operating units are located symmetrically in a transversal section preferably located in astern area in case of the units employed as steering device and between stern and middle ship in case of the units employed for stabilizing purpose.

7. The retractable fin device according to claim 6, wherein said actuators of said operating units are interconnected and maneuverable so that said respective fins can be retracted during sailing on calm waters or projected in the water totally or partially on one side or on the other one during sailing in rough seas, so as to act as stabilizing fins by creating a rotational torque on the longitudinal axis of the hull to oppose the effect of the roll.

8. The retractable fin device according to claim 7, wherein said fins are made from any sufficiently strong material selected from the group consisting of bronze, stainless steel, and titanium alloy, said fins having a substantially concave profile.

9. The retractable fin device according to claim 1, wherein each of said operating unit having at its top said actuator, said actuator consisting of a conventional double-acting hydraulic cylinder having a strong rod connectable to a base of said guide or to said fin, in order to move the latter vertically, while the body of said cylinder is connected, directly or by means of an interposed flange, to said cover of said tubular casing.

10. The retractable fin device according to claim 9, wherein each of said operating unit being provided with said double-acting cylinder having two concentric walls spaced to form a gap through which the oil for supplying a lower chamber of said cylinder can flow, thus allowing the oil to enter said cylinder at its top instead of at its base.

11. The retractable fin device according to claim 10 further comprising a connection being provided between said rod of said cylinder and said guide which in turn is secured to said fin, said connection being formed in such a way as to ensure that said guide can slide freely within said tubular casing, without jamming on said rod, said rod being provided for this purpose with a terminal disc which can transmit the thrust upwards and downwards, but since it is contained in a housing between said guide and said fin provided with sufficient radial clearance, can allow it to move freely.

12. The retractable fin device according to claim 11 further comprising a hydraulic circuit containing a pair of sequence valves fitted on the tops of said cylinders, to control the downward movement of one said fin only after said corresponding fin on the opposite side has been fully retracted, said sequence valves being provided with non-return valves operated directly by extensions of corresponding pistons which at the end of their strokes can raise push rods of valve shutters, thus enabling the oil to flow through them and supply said opposite cylinders.

13. A retractable fin device for steering or stabilizing a motorized watercraft having at least one hull, said retractable fin device comprising:

at least two operating units each having a retractable fin;

a tubular watertight casing associated with each of said operating units, said tubular casings each having at least one flange on its top to receive a watertight cover and an additional flange for its secure fixing to the hull, said additional flange being provided with a slot to allow the movement of said fin with a clearance which is sufficient to allow the water to flow out and in, said retractable fins of each operating unit being contained in said tubular casings, said casing being open on the bottom and located for their prevailing portion inside the hull, one on the starboard side and the other on the port side, said tubular casings have a generally rectangular configuration;

a guide connectable to each of said fins, said guides being closed the base and open at the top, said guides being characterized in that said corresponding fin can slide within said tubular casing and has a section similar to that of said tubular casing, said guides being reduced in scale to said tubular casing permitting the interposition of suitable anti-friction elements fitted to said guide; and an actuator attachable to each of said fins or guides for moving said fins outwards and inwards out of the hull during the navigation for a variable extent in the water, said actuators each consisting of a conventional double-acting hydraulic cylinder having a strong rod connectable to a base of said guide or to said fin, in order to move the latter vertically, while the body of said cylinder is connected, directly or by means of an interposed flange, to said cover of said tubular casing;

wherein said double-acting cylinders each having two concentric walls spaced to form a gap through which the oil for supplying a lower chamber of said cylinder can flow, thus allowing the oil to enter said cylinder at its top instead of at its base.

14. The retractable fin device according to claim 13, wherein said tubular casings of said operating units are located symmetrically in a transversal section located in astern area in case of the units employed as steering device and between stern and middle ship in case of the units employed for stabilizing purpose.

15. The retractable fin device according to claim 14, wherein said actuators of said operating units are interconnected and maneuverable so that said respective fins can be retracted during sailing on calm waters or projected in the water totally or partially on one side or on the other one during sailing in rough seas, so as to act as stabilizing fins by creating a rotational torque on the longitudinal axis of the hull to oppose the effect of the roll.

16. The retractable fin device according to claim 15 further comprising a connection being provided between said rod of said cylinder and said guide which in turn is secured to said fin, said connection being formed in such a way as to ensure that said guide can slide freely within said tubular casing, without jamming on said rod, said rod being provided for this purpose with a terminal disc which can transmit the thrust upwards and downwards, but since it is contained in a housing between said guide and said fin provided with sufficient radial play, can allow it to move freely.

17. The retractable fin device according to claim 16 further comprising a hydraulic circuit containing a pair of sequence valves fitted on the tops of said cylinders, to control the downward movement of one said fin only after said corresponding fin on the opposite side has been fully retracted, said sequence valves being provided with non-return valves operated directly by extensions of corresponding pistons which at the end of their strokes can raise push rods of valve shutters, thus enabling the oil to flow through them and supply said opposite cylinders.

18. The retractable fin device according to claim 17, wherein said fins are made from any sufficiently strong material selected from the group consisting of bronze, stainless steel, titanium alloy, and carbon fiber, said fins having a substantially concave profile.

19. A retractable fin device for steering or stabilizing a motorized watercraft having at least one hull, said retractable fin device comprising:

at least two operating units each having a retractable fin;

a tubular watertight casing associated with each of said operating units, said tubular casings each having at least one flange on its top to receive a watertight cover and an additional flange for its secure fixing to the hull, said additional flange being provided with a slot to allow the movement of said fin with a clearance which is sufficient to allow the water to flow out and in, said retractable fins of each operating unit being contained in said tubular casings, said casing being open on the bottom and located for their prevailing portion inside the hull, one on the starboard side and the other on the port side, said tubular casings have a generally rectangular configuration;

a guide connectable to each of said fins, said guides being closed the base and open at the top, said guides being characterized in that said corresponding fin can slide within said tubular casing and has a section similar to that of said tubular casing, said guides being reduced in scale to said tubular casing permitting the interposition of suitable anti-friction elements fitted to said guide and consisting of strips;

an actuator attachable to each of said fins or guides for moving said fins outwards and inwards out of the hull during the navigation for a variable extent in the water, said actuators each consisting of a conventional double-acting hydraulic cylinder having a strong rod connectable to a base of said guide or to said fin, in order to move the latter vertically, while the body of said cylinder is connected, directly or by means of an interposed flange, to said cover of said tubular casing, said double-acting cylinders each having two concentric walls spaced to form a gap through which the oil for supplying a lower chamber of said cylinder can flow, thus allowing the oil to enter said cylinder at its top instead of at its base;

a connection being provided between said rod of said cylinder and said guide which in turn is secured to said fin, said connection being formed in such a way as to ensure that said guide can slide freely within said tubular casing without jamming on said rod, said rod being provided with a terminal disc which can transmit the thrust upwards and downwards, and being contained in a housing between said guide and said fin providing sufficient radial clearance to move freely; and a hydraulic circuit containing a pair of sequence valves fitted on the tops of said cylinders to control the downward movement of one said fin only after said corresponding fin on the opposite side has been fully retracted, said sequence valves being provided with non-return valves operated directly by extensions of corresponding pistons which at the end of their strokes can raise push rods of valve shutters, thus enabling the oil to flow through them and supply said opposite cylinders;

wherein said tubular casings of said operating units are located symmetrically in a transversal section preferably located in astern area in case of the units employed as steering device and between stern and middle ship in case of the units employed for stabilizing purpose;

wherein said actuators of said operating units are interconnected and maneuverable so that said respective fins can be retracted during sailing on calm waters or projected alternatively in the water totally or partially on one side or on the other one during sailing in rough seas, so as to act as stabilizing fins by creating a rotational torque on the longitudinal axis of the hull to oppose the effect of the roll.

* * * * *